US007659852B2

(12) United States Patent
Hung et al.

(10) Patent No.: US 7,659,852 B2
(45) Date of Patent: Feb. 9, 2010

(54) MULTI-BAND ANTENNA WITH LOW-PROFILE

(75) Inventors: Chen-Ta Hung, Tu-Cheng (TW); Shu-Yean Wang, Tu-Cheng (TW); Lung-Sheng Tai, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 358 days.

(21) Appl. No.: 11/599,644

(22) Filed: Nov. 14, 2006

(65) Prior Publication Data

US 2007/0109199 A1 May 17, 2007

(30) Foreign Application Priority Data

Nov. 14, 2005 (TW) ..... 94139851 A

(51) Int. Cl.
*H01Q 1/38* (2006.01)
*H01Q 1/24* (2006.01)

(52) U.S. Cl. ..... 343/700 MS; 343/702

(58) Field of Classification Search ..... 343/700 MS, 343/702, 846

See application file for complete search history.

(56) References Cited

U.S. PATENT DOCUMENTS

| | | | | |
|---|---|---|---|---|
| 6,812,892 | B2 * | 11/2004 | Tai et al. | 343/700 MS |
| 7,119,747 | B2 * | 10/2006 | Lin et al. | 343/702 |
| 7,289,071 | B2 * | 10/2007 | Hung et al. | 343/702 |
| 2005/0190108 | A1 * | 9/2005 | Lin et al. | 343/702 |
| 2007/0030197 | A1 * | 2/2007 | Tsai et al. | 343/700 MS |
| 2007/0103367 | A1 * | 5/2007 | Wang | 343/700 MS |

FOREIGN PATENT DOCUMENTS

| | | |
|---|---|---|
| CN | 2593384 | 12/2003 |
| TW | M257522 | 2/2005 |
| TW | M258433 | 3/2005 |
| TW | I233713 | 6/2006 |

* cited by examiner

*Primary Examiner*—HoangAnh T Le
(74) *Attorney, Agent, or Firm*—Wei Te Chung; Andrew C. Cheng; Ming Chieh Chang

(57) ABSTRACT

A multi-band antenna includes a radiating element, a connecting element and a grounding element; the radiating element is made from a metal plate, and includes a first radiating portion and a second radiating portion having an end connect to one end of the first radiating portion. The first radiating portion, the second radiating portion and the connecting element is on the same planar, and the first radiating portion and the second radiating portion surround a rectangle rim.

14 Claims, 2 Drawing Sheets

MULTI-BAND ANTENNA WITH LOW-PROFILE

BACKGROUND OF THE INVENTION

1. Field of the Invention

The present invention relates generally to a multi-band antenna, and more particularly to a multi-band antenna used for electronic devices, such as notebook.

2. Description of the Prior Art

As communication technology is increasingly improved, the weight, volume, cost, performance, and complexity of a communication system also become more important, so antennas that transmit and receive signals in a wireless communication system especially draw designers attention. At present the wireless local area network (WLAN) and General Packer Radio Service (GPRS), because the space for setting up an antenna is limited and the antenna should transmit a large amount of data, the antenna should be carefully designed.

Planar Inverted-F Antenna (PIFA) is a kind of small size antennas used for mobile communication terminal. The antenna has light weight, good impedance, compact size, reduced manufacture cost and perform a double-band or a multi-band antenna easily. CN pat. No. 2593384 discloses a Planar Inverted-F Antenna, it comprises two radiating elements each of which respectively extends along different directions, a grounding element, and a connecting element connecting the radiating elements and the grounding element. This antenna can performs multi-band frequency, but the whole length of the connecting element is so long that this antenna takes up big space in the notebooks or the carry-home electric devices. So, this kind antenna is not propitious to the smaller-device trend.

Hence, an improved antenna is desired to overcome the above-mentioned shortcomings of the existing antennas.

BRIEF SUMMARY OF THE INVENTION

A primary object, therefore, of the present invention is to provide a multi-band antenna having low profile with simple structure, and reduced size.

In order to implement the above object and overcomes the above-identified deficiencies in the prior art, the multi-band antenna comprises a radiating element, a connecting element and a grounding element; the radiating element is made from metal plate, and comprises a first radiating portion and a second radiating portion having an end connect to one end of the first radiating portion. The first radiating portion, the second radiating portion and the connecting element is on the same planar, and the first radiating portion and the second radiating portion surround a rectangle rim.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment

Figure 1:
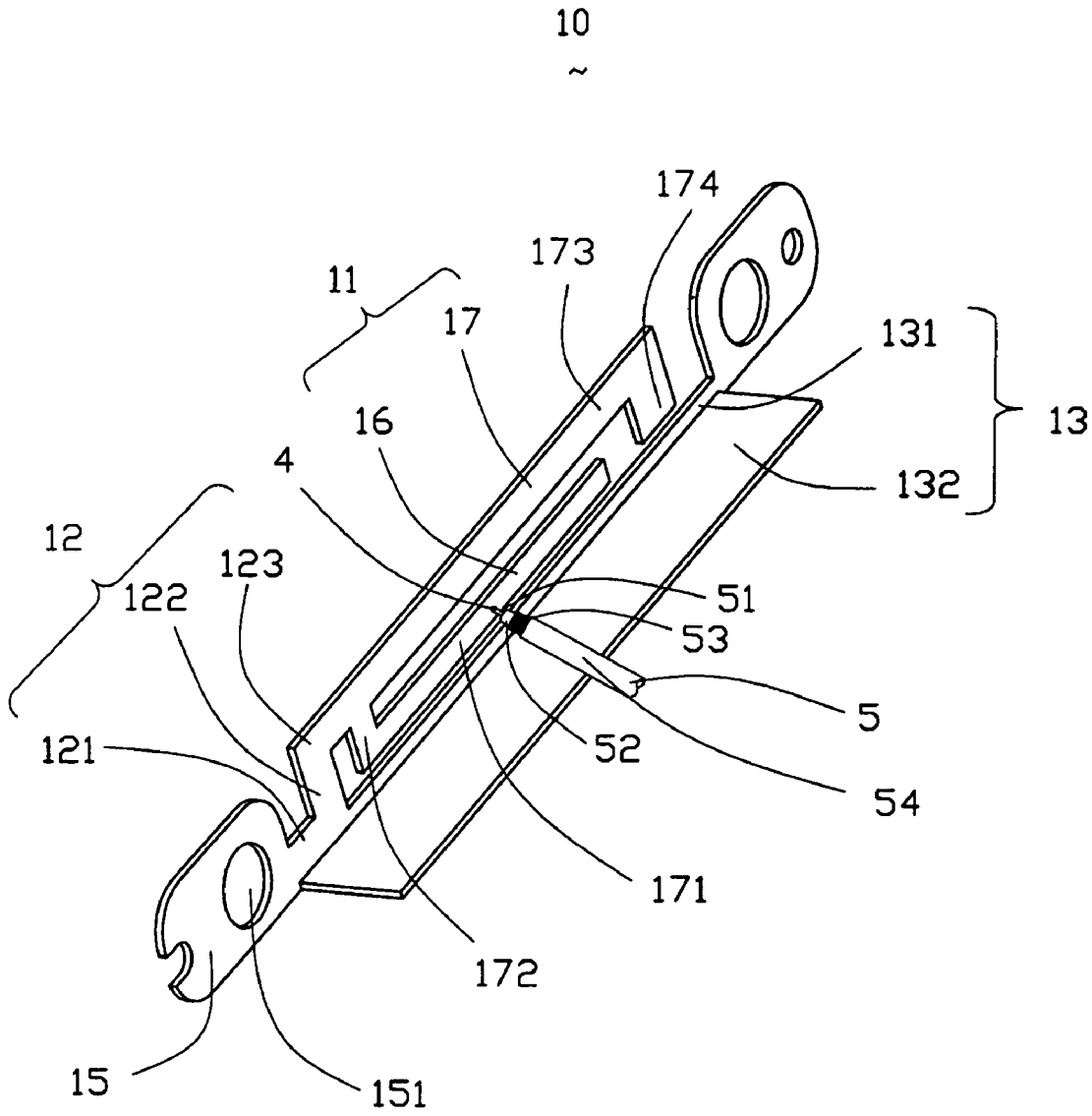
FIG. 1 is a perspective view of a multi-band antenna according to a preferred embodiment of the present invention.

Reference to FIG. 1 in one embodiment of the present invention, the multi-band antenna 10 comprises a radiating element 11, a grounding element 13, a connecting element 12 connecting the radiating element 11 and the grounding element 13, a feeding point 4, a feeding line 5 and two setting elements 15.

The radiating element 11 comprises a first radiating portion 16 and a second radiating portion 17. The first radiating portion 16 is a high-frequency radiating portion which is worked at 5 GHz, and the second portion 17 is low-frequency radiating portion which is worked at 2.4 GHz. The radiating portion 17 comprises a horizontal first radiating arm 171, a second radiating arm 172 extending from left end of the first radiating arm 171 and perpendicular to the first radiating arm 171, and a horizontal third radiating arm 173 extending from the second radiating arm 172 in the neighborhood of the first radiating arm 171 and perpendicular to the second radiating arm 172, and a fourth radiating arm 174 extending downwardly from the right end of the third radiating arm 173 in the neighborhood of the first radiating arm 171 and perpendicular to the third radiating arm 173. The first radiating portion 16 extends from the right end of the first radiating arm 171 of the second radiating portion 17 opposite to the left end of the first radiating arm 171 connecting the second radiating arm 172. The first radiating portion 16 and the second radiating portion 17 form a rectangle frame with formed between the first radiating portion 16 and the fourth radiating arm 174, so that the total length of the multi-band antenna 10 is reduced. The radiating element 11 and the connecting element 12 are in the same plane, and the first radiating portion 16 and the fourth radiating arm 174 of the radiating element 11 are located at the same of the connecting element 12, so that the total height of the multi-band antenna 10 could be reduced.

The grounding element 13 comprises a first grounding portion 131 and a second grounding portion 132 perpendicular to the first grounding portion 131. The first grounding portion 131 is perpendicular to the second grounding portion 132.

The connecting element 12 is Z shape, and the radiating element 11 and the first grounding portion 131 are all in the same plane. The connecting portion 12 comprises a first section 121, a third section 123 connecting the joint of the second radiating arm 171 of the second radiating portion 17 and the third radiating arm 173, and a vertical second portion 122 connecting the first portion 121 and the third portion 123.

The feeding point 4 is located at the joint of the first radiating portion 16 and the second radiating portion 17. The feeding line 5 comprises an inner conductor 51 soldered on the feeding point 4, an inner isolator 52 covering the inner conductor 51, an outer conductor layer 53 soldered on the second grounding portion 132 and an outer isolator 54 encircling the outer conductor 53. The two setting elements 15 respectively extend from opposite ends of the grounding element 13 and each of them respectively has a circular aperture to assemble the multi-band antenna 10 to the electric device. The radiating element 11 and the pair of the setting elements are in the same plane which is perpendicular to the plane on which the second grounding portion is located. And the height of the radiating element is lower than the height of the setting element. It is noted that a gap defined between the tip of the fourth radiating arm 174 and the first grounding portion 131 is not larger than that between the first radiating arm 171 and the first grounding portion 131.

Figure 2:
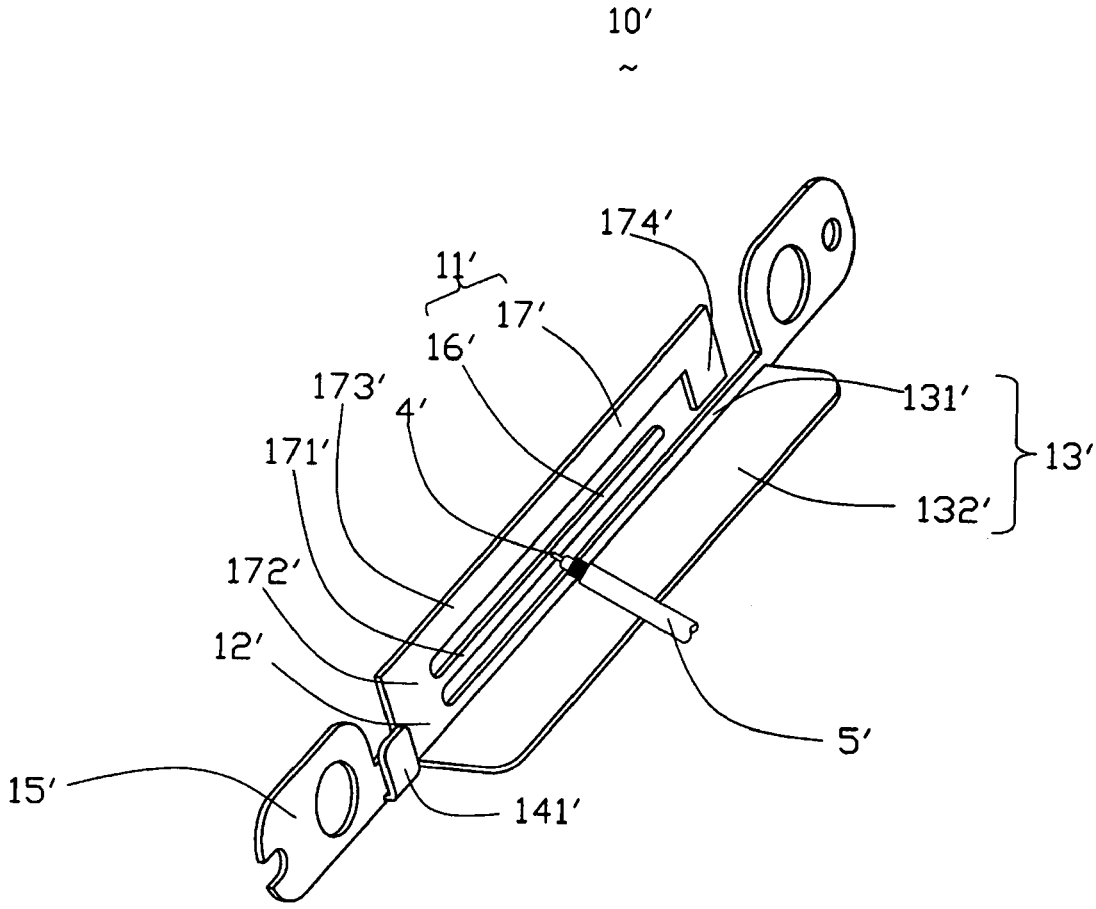
FIG. 2 is a perspective view of a multi-band antenna according to another preferred embodiment of the present invention.

Reference to FIG. 2 in another embodiment of the present invention, the multi-band antenna 10' comprises a radiating element 11', a grounding element 13 ', a connecting element 12' connecting the radiating element 11' and the grounding element 13', a feeding point 4', a feeding line 5', and two setting elements 15'. In this embodiment, the feeding point 4', and the feeding line 5' are the same as the structures of the first embodiment.

The radiating element 11' comprises a first radiating portion 16' and a second radiating portion 17'. The second radiating portion 16' comprises a horizontal first radiating arm 171', a second radiating arm 172' extending from left end of the first radiating arm 171' in the vertical direction, a third horizontal radiating arm 173 ' extending from one end of the second radiating arm 172' in the neighborhood of the first radiating arm 171' in the perpendicular direction to the second radiating arm 172', and a fourth radiating arm 174' extending from the third radiating arm 173' in the neighborhood of right end of the first radiating arm 171' and in the vertical direction to the third radiating arm 173'. The grounding element 13' comprises a first grounding section 131' and a second grounding section 132'. A protrude 141' extends from the second grounding section 132 located between the two setting elements 15' and one end of the connecting element 12' to fasten the feed line. The connecting element 12' extends from one end of the second radiating arm 172' and aligned with the second radiating arm 172' in the vertical direction. The length of the connecting element 12' in the vertical direction is the same as the length of the least distance between the radiating element 11' and the grounding element 13'. The connecting element 12'and the radiating element 11' are in the same plane and connect with the grounding element 13' in another end thereof.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. A multi-band antenna, comprising:

a radiating element, made from a metal plate, and comprising a first radiating portion and a second radiating portion connecting one end of said first radiating portion;

a grounding element;

a connecting element connecting with the radiating element and the grounding element;

a feeding point on the joint of the first and second radiating portion and apart from the connecting element;

wherein said first radiating portion, said second radiating portion and said connecting element are in the same plane, said first radiating portion and said second radiating portion surround a rectangle frame with a gap formed therebetween.

2. The multi-band antenna as claimed in claim 1, wherein said first radiating portion and said second radiating portion are located at the same side of the connecting element.

3. The multi-band antenna as claimed in claim 2, wherein said connecting element is Z shape, and comprises a first section connecting with said grounding element, a third portion connecting with said radiating element, and a second portion connecting said first portion and said second portion.

4. The multi-band antenna as claimed in claim 3, wherein said second radiating portion comprises a first radiating arm, a second radiating arm, a third radiating arm, and a fourth radiating arm; and said first radiating arm is parallel to said third radiating arm, said second radiating arm is parallel to said fourth radiating arm, and said first radiating arm and said third radiating arm are vertical to said second radiating arm and the fourth radiating arm.

5. The multi-band antenna as claimed in claim 4, wherein said first radiating arm is in line with the first radiating portion.

6. The multi-band antenna as claimed in claim 4, wherein said second radiating arm connects with said third radiating arm at one end of the connecting element.

7. The multi-band antenna as claimed in claim 1, wherein said second radiating portion comprises a first radiating arm, a second radiating arm extending from one end of the first radiating arm in the vertical direction, a third radiating arm extending from one end of the second radiating arm in the neighborhood of the first radiating arm in the vertical direction to the second radiating arm, and a fourth radiating arm extending from the third radiating arm in the neighborhood of the first radiating arm and in the vertical direction to the third radiating arm.

8. The multi-band antenna as claimed in claim 7, wherein said connecting element is located on the same line as said second radiating arm, and the length of the connecting element is equal to the least distance between said radiating element and said grounding element.

9. The multi-band antenna as claimed in claim 8, wherein said first radiating portion and said first radiating arm of said second radiating portion are in the same line but respectively extends in a different direction.

10. The multi-band antenna as claimed in claim 7, wherein said gap is located between said radiating arm of said second radiating portion and said free end of said first radiating portion.

11. A multi-band antenna, comprising:

a radiating element, made from a metal plate, and comprising a first radiating portion having a first main body extending along a horizontal direction, and a second radiating portion having a second main body extending along said horizontal direction and parallel to the first main body;

a grounding element extending along said horizontal direction and located at a level closer to the second main body than the first main body;

a connecting element having a lower portion connecting to the grounding element, and an upper portion connecting to both said first radiating portion and said second radiating portion; and a feeder cable including an outer conductor connected to the grounding element, and an inner conductor connected to the second body; wherein the first radiating portion includes an downward lying L-shaped configuration defining a first radiating arm extending along said first main body, and a second radiating arm extending downwardly from an end of said first radiating arm toward the grounding element wherein a gap between a tip of the second radiating arm and the grounding element in a vertical direction is not larger than that between the second radiating portion and the grounding element.

12. The multi-band antenna as claim 11, wherein the second radiating portion includes an upward lying L-shaped configuration including said second main body while mutually in a reverse manner with regard to the downward lying L-shaped configuration of the first radiating portion.

13. The multi-band antenna as claimed in claim 11, wherein said connecting element includes an upside-down standing L-shaped configuration defining a vertical section and a horizontal section under condition of said horizontal section being horizontally aligned with the first main body.

14. The multi-band antenna as claimed in claim 11, wherein said first radiating portion further includes a third radiating arm downwardly extending from the other end of the first main body opposite to the second radiating arm and connected to the connecting element at a position, and said second main body is connected to the connecting element at the same position.

* * * * *